United States Patent [19]

Haussmann

[11] Patent Number: 5,076,353

[45] Date of Patent: Dec. 31, 1991

[54] LIQUEFIER FOR THE COOLANT IN A VEHICLE AIR-CONDITIONING SYSTEM

[75] Inventor: Roland Haussmann, Wiesloch, Fed. Rep. of Germany

[73] Assignee: Thermal-Werke Wärme, Kälte-, Klimatechnik GmbH, Hockenheim, Fed. Rep. of Germany

[21] Appl. No.: 533,871

[22] Filed: Jun. 6, 1990

[30] Foreign Application Priority Data

Jun. 6, 1989 [DE] Fed. Rep. of Germany ..... 3918455
Nov. 23, 1989 [DE] Fed. Rep. of Germany ..... 3938842

[51] Int. Cl.[5] ..... F28F 13/00; F28B 1/06

[52] U.S. Cl. ..... 165/110; 165/113; 165/146; 165/144; 165/151; 165/150; 62/507

[58] Field of Search ..... 165/113, 110, 146, 135, 165/144, 140, 150, 151; 62/507

[56] References Cited

U.S. PATENT DOCUMENTS 2,963,277 12/1960 Heller et al. ..... 165/151
4,691,767 9/1987 Tanaka et al. ..... 165/151
4,791,984 12/1988 Hatada et al. ..... 165/151

FOREIGN PATENT DOCUMENTS 1685651 10/1954 Fed. Rep. of Germany .
1072257 12/1959 Fed. Rep. of Germany .
3406682 9/1985 Fed. Rep. of Germany .
3544921 7/1987 Fed. Rep. of Germany .
108394 6/1983 Japan ..... 165/135

OTHER PUBLICATIONS

Federal Republic of Germany Search Report for German Application No. P 39 18 455.2, filed Jun. 6th, 1989, dated Nov. 20th, 1989.

*Primary Examiner*—Albert W. Davis, Jr.
*Attorney, Agent, or Firm*—Spencer & Frank

[57] ABSTRACT

A liquefier for the coolant in a vehicle air-conditioning system equipped with finned heat exchange tubes through which the coolant is conducted in cross-current to the inflowing ambient air. The heat exchange tubes are arranged in several rows of tubes disposed one behind the other in the direction of flow of the incoming ambient air with the respective heat exchange tubes being connected in cross-countercurrent flow. The rows of tubes are subdivided into several component groups (14, 16) which are arranged one behind the other in the direction of flow of the incoming ambient air, with their fin arrangements being decoupled with respect to thermal conduction. The component groups (14, 16) are connected in series with respect to the coolant and in countercurrent to the direction of flow of the incoming ambient air. According to the invention, adjacent component groups (14, 16) are mechanically connected with one another by way of their fin arrangement, but, in a connection zone between each two adjacent component groups (14, 16), the average thermal conductivity $\lambda_m$ lies below 20% of the thermal conductivity $\lambda$ of the material of the fin arrangement of the two adjacent component groups (14, 16).

20 Claims, 15 Drawing Sheets

LIQUEFIER FOR THE COOLANT IN A VEHICLE AIR-CONDITIONING SYSTEM

BACKGROUND OF THE INVENTION

The invention relates to a liquefier for the coolant in a vehicle air-conditioning system, the liquefier including finned heat exchange tubes through which the coolant is conducted in cross-current to the inflowing ambient air. The heat exchange tubes are arranged in several rows of tubes that are disposed behind one another in the direction of flow of the incoming ambient air and whose respective heat exchange tubes are interconnected in a cross-countercurrent arrangement. Preferably, but not exclusively, the fin arrangement is composed of foils made of aluminum, copper or alloys of these materials, each having a thickness of less than 0.15 mm.

Such liquefiers for vehicle air-conditioning systems are customary in the trade. In the past, all heat exchange tubes were provided with a common arrangement of fins which were provided, in certain cases already for the purpose of improving the heat exchange, with projection-like interruptions. Such projection-like interruptions were always oriented in such a manner that an optimal heat flow occurred from the tube into the projection of the respective interruption. Accordingly, such projection-like interruptions extended along the connecting line of tubes of the same row of tubes or along the connecting line of immediately adjacent tubes of adjacent rows of tubes. However, the heat flow between adjacent tubes of the same row of tubes or immediately adjacent rows of tubes is not reduced thereby. Moreover, the pattern of such projection-like interruptions which increase the efficiency of the heat transfer is uniformly distributed over the entire fin arrangement.

In these prior art liquefiers, the good heat-conductive connection between adjacent rows of tubes in the fin arrangement through which the medium flows in opposite directions causes an average temperature level to be established which has a performance reducing effect. This reduction in performance is so distinct that a cross-countercurrent, which theoretically is able to produce a considerably higher effective temperature difference, brings practically no improvement in performance compared to a simple cross-current. This effect is augmented in liquefiers for the coolant of a vehicle air-conditioning system in that the tubes of adjacent rows of tubes (considering in each case in the direction of flow of the ambient air) are very small and thus the flow of heat transferred by way of the fin arrangement between the tubes of adjacent rows of tubes is particularly great. In the present connection, the particularly serious heat losses due to heat conduction are given exclusive consideration while the heat losses due to radiation, which are smaller by about one order of magnitude, are not to be considered here.

A prior art liquefier, German Gebrauchsmuster (utility model) 1,685,651, for the refrigerant of a refrigerator—that is, not for use according to the invention in a vehicle air-conditioning system—is composed, depending on the performance requirement, of one component group or several identical component groups which are then arranged according to the features of the preamble of claim 1 and are interconnected in cross-countercurrent. Each one of the component groups includes only one row of tubes and they are physically separated from one another and thus also with respect to thermal conduction.

If adjacent component groups are completely mechanically decoupled from one another and thus automatically also with respect to thermal conduction, problems arise with respect to the mechanical strength of the entire liquefier and also considerably higher manufacturing costs since practically at least two separate liquefiers must be produced and connected with respect to flow in the smallest possible, unchanged space. These problems become considerably more serious in connection with liquefiers for the coolant of a vehicle air-conditioning system due to their small dimensions in adaptation to the small space available in motor vehicles.

SUMMARY OF THE INVENTION

It is the object of the invention to utilize the advantages of cross-countercurrent operation also for a coolant liquefier intended for use in a vehicle air-conditioning system.

The above object is generally achieved according to the invention by a liquefier for the coolant in a vehicle air-conditioning system having finned heat exchange tubes through which the coolant is conducted in a cross-current to the inflowing ambient air. The heat exchange tubes are arranged in a plurality of rows of tubes disposed behind one another in the direction of flow of the incoming ambient air so that respective heat exchange tubes are interconnected in a cross-countercurrent arrangement. The rows of tubes are subdivided into a plurality of component groups which are arranged behind one another in the direction of flow of the incoming ambient air, with their fin arrangements being decoupled with respect to thermal conduction. The component groups are connected in series with respect to the coolant and in countercurrent to the direction of flow of the incoming ambient air, with adjacent component groups being mechanically connected by way of their fin arrangements. Additionally, in a connection zone between each two adjacent component groups, the average thermal conductivity $\lambda_m$ lies below 20% of the thermal conductivity $\lambda$ of the material of the fin arrangement of the two adjacent component groups.

In the liquefier according to the invention, there is a physical combination of several component groups, preferably all component groups, by way of a common fin arrangement or finning. This increases the mechanical strength of the entire liquefier, particularly with the small dimensions of liquefiers in vehicle air-conditioning systems, with it being possible even to manufacture the liquefier in one piece, at least, however, by combining several component groups or several rows of tubes, respectively. Substantial decoupling with respect to thermal conduction is here effected by the appropriate configuration of the fin arrangement between the component groups. Only the combination of the component groups makes manufacture and manipulation of the small-dimension liquefiers for vehicle air-conditioning systems, or at least combined parts thereof, appropriate and possible in practice.

Conceivable possibilities of decoupling adjacent component groups with respect to thermal conduction along a continuous fin arrangement are, for example, the installation of insulating material, weakening of the cross section, a change in resistance due to doping, or the like. However, such possibilities are relatively expensive so that a preferred configuration includes a liquefier in which (every) two adjacent component groups have a common fin arrangement which extends alongside the connection zone between the two component groups, and a succession of interruptions between which connecting webs remain and which are each disposed between pairs of heat exchange tubes belonging to directly adjacent rows of tubes in the two adjacent component groups.

In this preferred configuration, the material of the fin arrangement for the heat exchange tubes of adjacent component groups may be the same as in the prior art liquefiers for motor vehicle air-conditioning systems. However, the suitable arrangement of interruptions along the connection zone between the two component groups significantly reduces the heat flow due to thermal conduction in these areas. It has been found that even if the fin arrangement is configured as foils having a thickness of less than 0.15 mm, the coaction of these foils in the form of a dense packet still provides sufficient mechanical strength for the entire liquefier, with the component groups being mechanically combined, in the extreme case, without any additional strengthening measures. Moreover, the advantage is retained of being able to provide the heat exchange tubes of different component groups with fins in one process phase as in a conventional liquefier and thus retain the manufacturing advantages of the prior art liquefiers. Preferably, as measured in the direction in which the connection extends, the average length of the connecting webs is less than 50%, preferably less than 20%, and most preferably less than 10% of the average length of the interruptions. However, decouplings with respect, to thermal conduction of a degree less than these values still results in a noticeable increase in the temperature difference between coolant and ambient air.

In a modification of the above-described embodiment, which is preferred in practice, the fin region of each row of tubes takes on the temperature of the coolant of the respective row of tubes practically directly and practically without interaction with other rows of tubes. It has been found that surprising, unusually high improvements in efficiency can here be realized compared to the best conventional comparable liquefiers. With the same amount of material or the same structural depth and the same pressure loss on the air side, improvements in efficiency in an order of magnitude of 25% can be realized which can be taken advantage of, for example, in a correspondingly smaller structural depth with the same cooling performance.

In all liquefiers according to the invention for vehicle air-conditioning systems the fin arrangements of all heat exchange tubes are intentionally not designed to be uniform and instead at least two component groups are selected to be decoupled with respect to thermal conduction. During cross-countercurrent operation, the flow through these component groups turns in the opposite direction. It may remain open here how, in detail, the heat exchange tubes in each individual component group are interconnected, for example, in cross-current flow in each component group or also individually in cross-countercurrent. Or known types of such connecting elements may be combined in each component group. In an extreme case, each row of tubes could even have an associated component group and the flow through each row of tubes could be in a turn in the opposite direction. However, it has been found that for practical applications, usually only two component groups need be decoupled with respect to thermal conduction even if these component groups individually or both together include more than one row of tubes. Preferred here are three or four rows of tubes, with the first-mentioned case having one row of tubes arranged in one component group and the other two rows of tubes arranged in a second component group, while in the second-mentioned case, two rows of tubes are arranged in each one of the two component groups.

In a liquefier according to the invention for vehicle air-conditioning systems, it is no longer possible for an average temperature to develop in a common fin arrangement of adjacent heat exchange tubes from different component groups, instead a more or less distinct jump in temperature occurs between the two component groups which is most noticeable in the extreme case of a mechanically complete separation of the fin arrangements of adjacent component groups.

The effective temperature difference between the coolant, on the one hand, and the ambient air, on the other hand, can be increased significantly once more in the configuration of the liquefier in which a (first) component group through which the coolant flows first is configured to have a relatively low pressure loss on the coolant side and a (second) component group through which the coolant flows subsequently is configured to have a relatively high pressure loss on the coolant side. Here the dimensions for the two component groups in question are preferably such the pressure loss of the first component group is dimensioned in such a way that the product of the effective temperature difference ($\Delta t_{log}$) between the ambient air and the coolant, and the thermal transition coefficient k, is a maximum value, and such that the pressure loss of the second component group is dimensioned so large that the exit temperature ($t_{KA}$) of the liquefied coolant lies in the range between its minimum and the minimum of the saturation temperature ($t_{KE}$) of the coolant entering into the liquefier. The significance of these measures will be described in greater detail below with reference to function diagrams of the significant parameters (FIGS. 9 to 11). (German Auslegeschrift printed, laid-open application) 1,072,257 discloses the changing of the number of tubes along the coolant flow path through which it flows in parallel so that the pressure gradient is essentially constant over the entire flow path.

According to preferred features of the invention, the material of the fins may be removed, or particularly punched out, for the interruptions in the connection zone between adjacent component groups. In this case, small slots are preferably employed so as to lose as little fin material as possible. However, according to a further modification, projections of material are webs which are bent out of one side of the fin arrangement, preferably so as to form louvers, and projections of material are cut out on both sides of the fin arrangement, so that the material of the fins may also be utilized in the region of the interruptions to form projections which additionally enhance the heat transfer between coolant and ambient air.

It has been found that not all interruptions within the connection zone between adjacent component groups need be newly created, rather the earlier mentioned known projection-like interruptions, which in the past were provided between tubes of a row only to enhance heat transfer, can be incorporated into the decoupling with respect to thermal conduction between the two adjacent component groups.

In a variant of the preferred embodiment of the invention described immediately above, a liquefier has the known interruptions between the tubes of a respective row are configured as louvers while the remaining interruptions, which are additionally provided to separate the rows of tubes with respect to thermal conduction, may be configured as simple thermal conduction interruptions without louver formation. In this connection, reference is made, in particular, to the alternative possibilities of FIG. 8.

It is possible to select the connection zone between adjacent component groups to be a straight line or a rectilinear zone which extends parallel to the rows of tubes. However, a polygonal or wavy configuration of the connection zone between adjacent component groups, that is a configuration composed of linear sections or curved sections, may even be preferred. This is particularly applicable for the case where the tubes are offset relative to one another in the direction of flow of the ambient air and known projection-like recesses of a known type for increasing the heat transfer are incorporated in the sequence of recesses provided for the decoupling with respect to thermal conduction between adjacent component groups.

Various possible arrangements of the interruptions for liquefiers according to the invention will be described in detail below.

BRIEF DESCRIPTION OF THE DRAWINGS

The invention will now be described in even greater detail with reference to several embodiments thereof that are illustrated in schematic drawings wherein:

FIGS. 9 to 11 show three function diagrams, wherein

DESCRIPTION OF THE PREFERRED EMBODIMENTS

Figure 14:
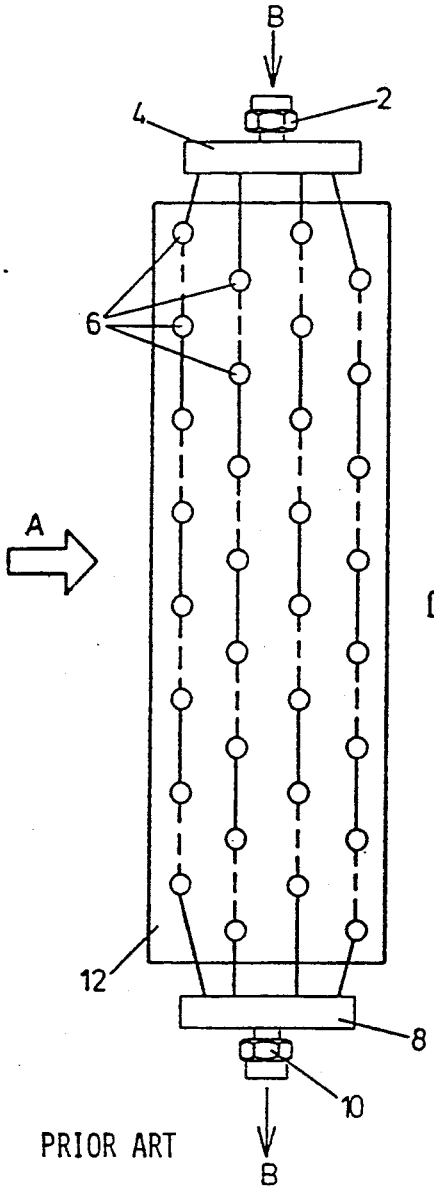
PRIOR ART FIG. 14
Figure 15:
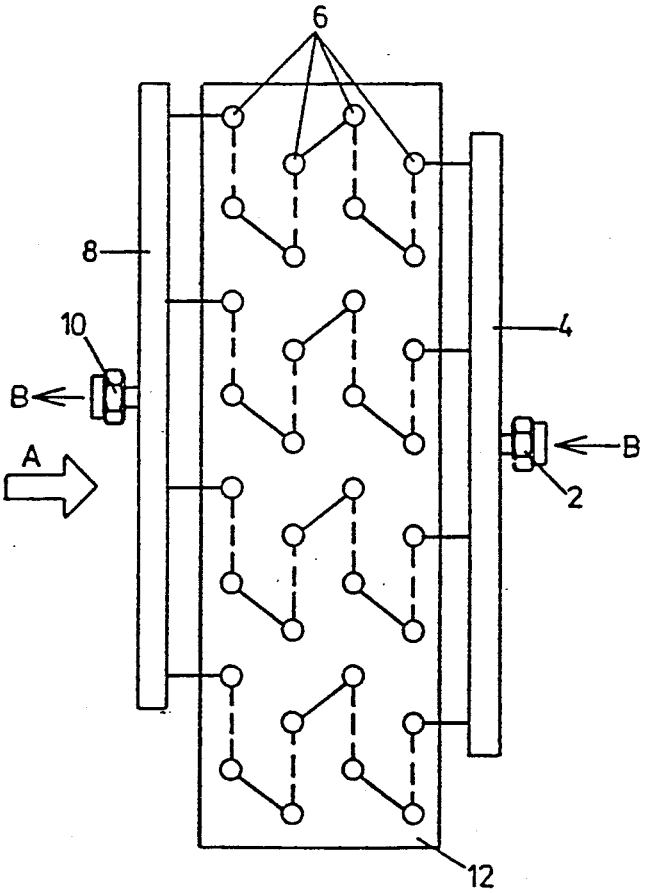
PRIOR ART FIG. 15

In FIGS. 14 and 15, which are provided to illustrate the prior art liquefiers, the direction in which the ambient air flows in is shown by arrows A. In both embodiments, four rows of tubes are arranged transversely to the direction of incoming flow.

In the cross-current operation according to FIG. 14, the coolant is introduced through a port 2 into a header 4 which is connected with the inlets of the four rows of finned heat exchange tubes 6. All heat exchange tubes 6 here have a common, uniformly configured fin arrangement. At their outlets, the four rows of heat exchange tubes 6 are connected to a further header 8 which is provided with an outlet 10 for the coolant. It can be seen that in the four rows the coolant flows in parallel from header 4 to header 8 and intersects with the inflowing ambient air.

In FIG. 15, the same configuration of finned heat exchange tubes 6 is connected in cross-countercurrent with respect to the inflowing ambient air. Four direction reversing turns are shown between the two headers 4 and 8 at their inlets and outlets, with the coolant, on the one hand, intersecting the inflowing ambient air and, on the other hand, flowing in countercurrent to this flow from the header 4 at the inlet to the header 8 at the outlet.

In the illustrated embodiment, each direction reversing turn connects only two adjacent tubes of a row. It is also known to increase the pressure loss in each flow-carrying branch between headers 4 and 8 by increasing the number of tubes per row up to the extreme case in which only a single tube coil and direction reversing turn is disposed between the inlet port 2 and outlet 10.

The common fin arrangement for all heat exchange tubes by means of foils, particularly of aluminum or an aluminum alloy, having a thickness of less than 0.15 mm, customarily up to about 0.1 mm, is shown at 12.

The prior art embodiments shown in FIGS. 14 and 15 relates specifically to round tube heat exchangers.

Figure 1A:
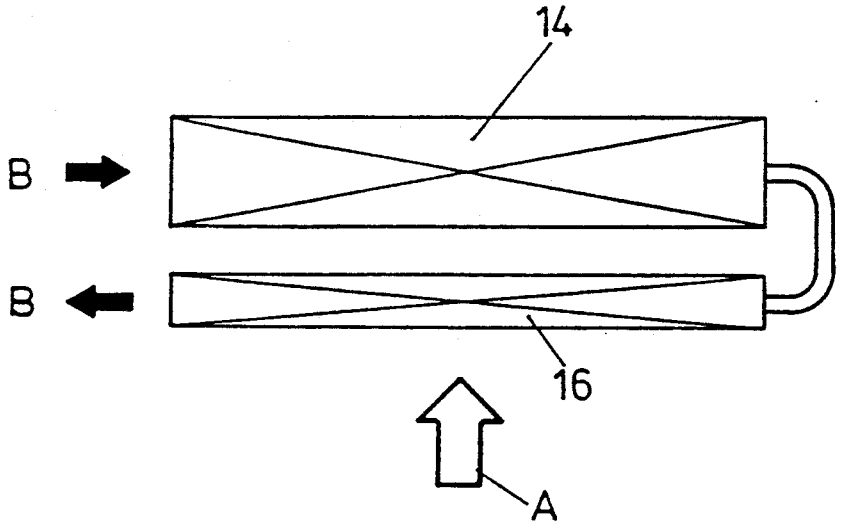
FIG. 1 illustrates a round tube finned heat exchanger and its basic circuit diagram (a) as well as a perspective illustration of the fin blocks without interconnection in variation (b)
Figure 1B:
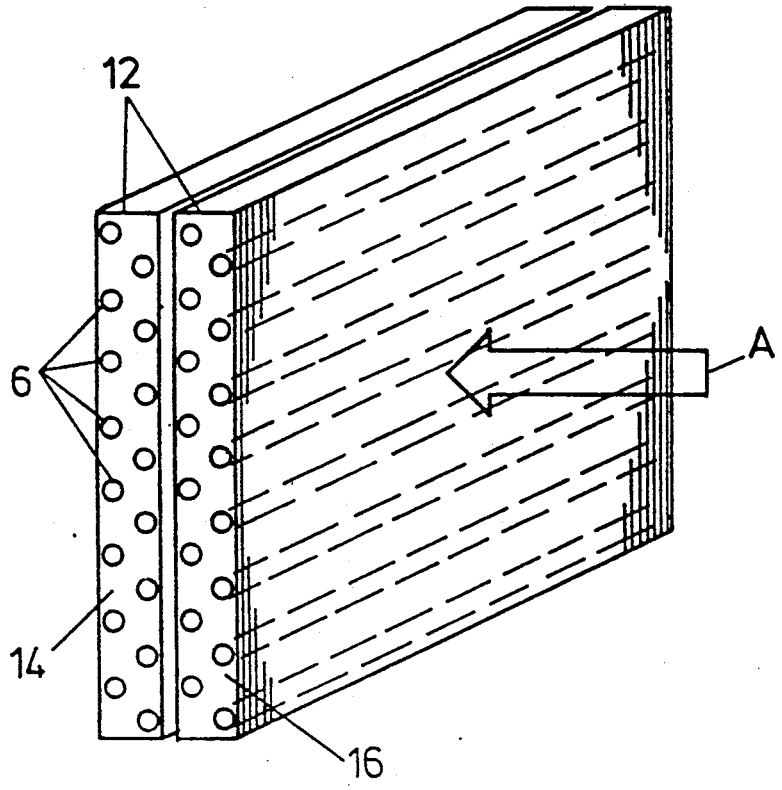

FIG. 1 now illustrates the invention likewise for a round tube heat exchanger.

Here the liquefier is divided into two component groups 14 and 16 of which each, without limiting its general applicability, includes two rows of tubes. The special case of only two component groups 14 and 16 is discussed here, where component group 14 is disposed at the coolant inlet side and component group 16 at the coolant outlet side and both component groups are connected as direction reversing turns (illustrated variation (a)).

In the illustrated embodiment, each component group has its own individual fin arrangement of foils made of aluminum, copper or alloys of these materials having a thickness of less than 0.15 mm down to, according to present-day rolling technology, a minimum of 0.08 mm. However, the same type of interconnection may also be provided for component groups which, according to embodiments to be discussed below, have common fin arrangements made of such foils.

Figure 2:
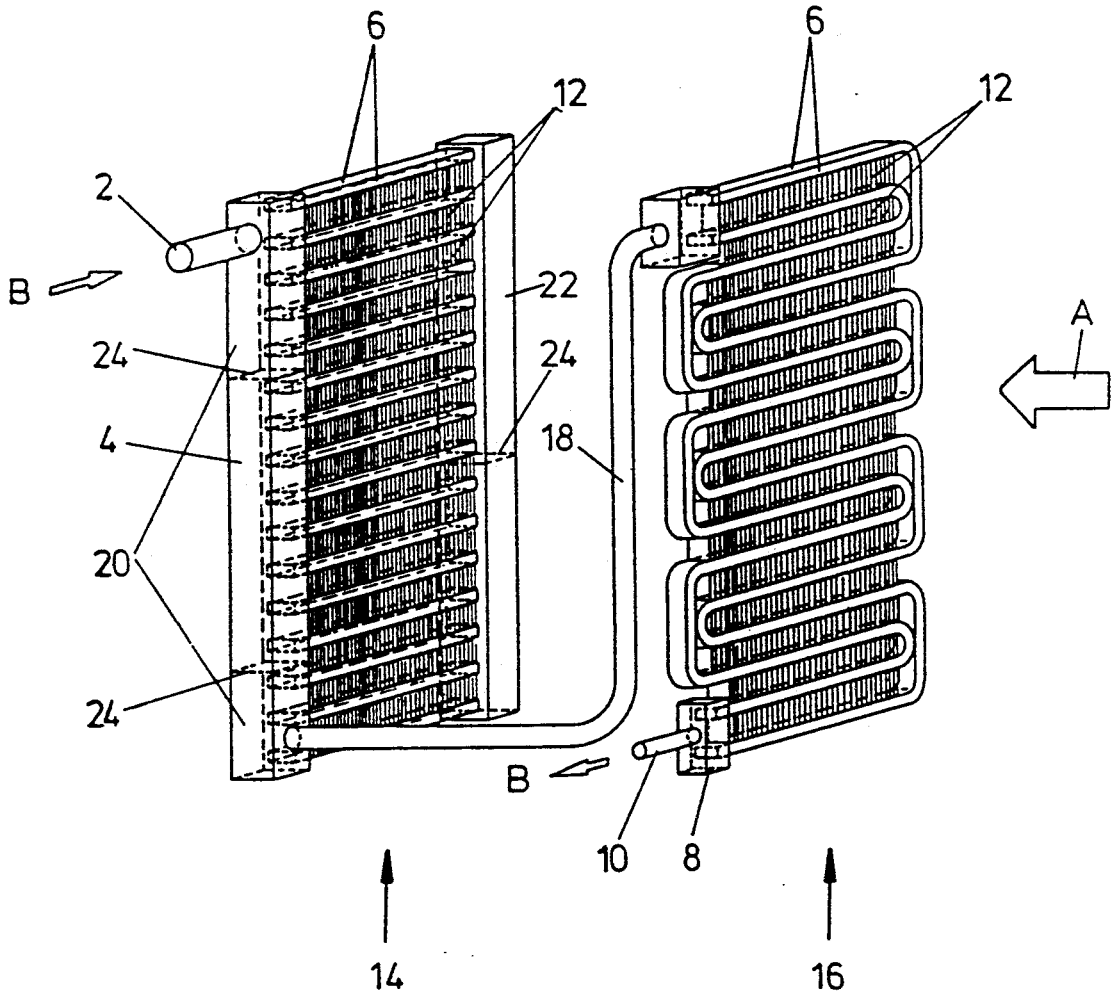
FIG. 2 is a perspective view of a flat tube liquefier showing its interconnections.

FIG. 2 shows the interconnection according to FIG. 1 transferred to two component groups 14 and 16 which are here configured as flat tube heat exchangers and also each have their own laminar fin arrangements of foils which here advisably have thicknesses between 0.15 and 0.25 mm.

In the embodiment according to FIG. 1 as well as in that according to FIG. 2, the direction of coolant flow is indicated by arrows B.

The flow reversing tube connection between the two component groups 14 and 16 is likewise marked 18 in both embodiments.

While in FIG. 1 the interconnection of the tubes of the respective component group 14 or 16 is left open, the interconnection in the embodiment of FIG. 2 is provided in a pure cross-current in each individual component group 14 and 16, respectively.

The difference in thickness shown for the two component groups in FIG. 1 is intended to illustrate that the first component group 14 through which the coolant flows first is designed to have a relatively low pressure loss on the cold side and the second component group 16 through which the coolant flows next is designed to have a relatively high pressure loss on the cold side.

A corresponding design is illustrated even more clearly in the flat tube liquefier according to FIG. 2 by the interconnection of the individual heat exchange tubes in the respective component groups 14 and 16. The relatively low pressure loss is here realized in that groups of relatively large numbers of heat exchange tubes, here involving the numbers 5, 4, 4 and 3, are brought back and forth between individual divisions 20 of inlet header 22, with the divisions of the headers being produced by partitions 24. In the second component group 16 at the outlet, the groups of tubes are brought back and forth in a corresponding manner, with, however, each group of tubes including only two tubes. This is realized in that two parallel extending tube coils are boxed inside one another and are connected with one another by simple tube arcs. By reducing the number of tubes per group, a considerable increase in pressure loss in component group 16 relative to component group 14 has here been realized even with the cross section of the individual heat exchange tubes 6 remaining the same. It can thus be seen that the requirements for pressure loss in the respective group of tubes can be realized even without changing the cross section of the heat exchange tubes merely by interconnection means.

Figure 3:
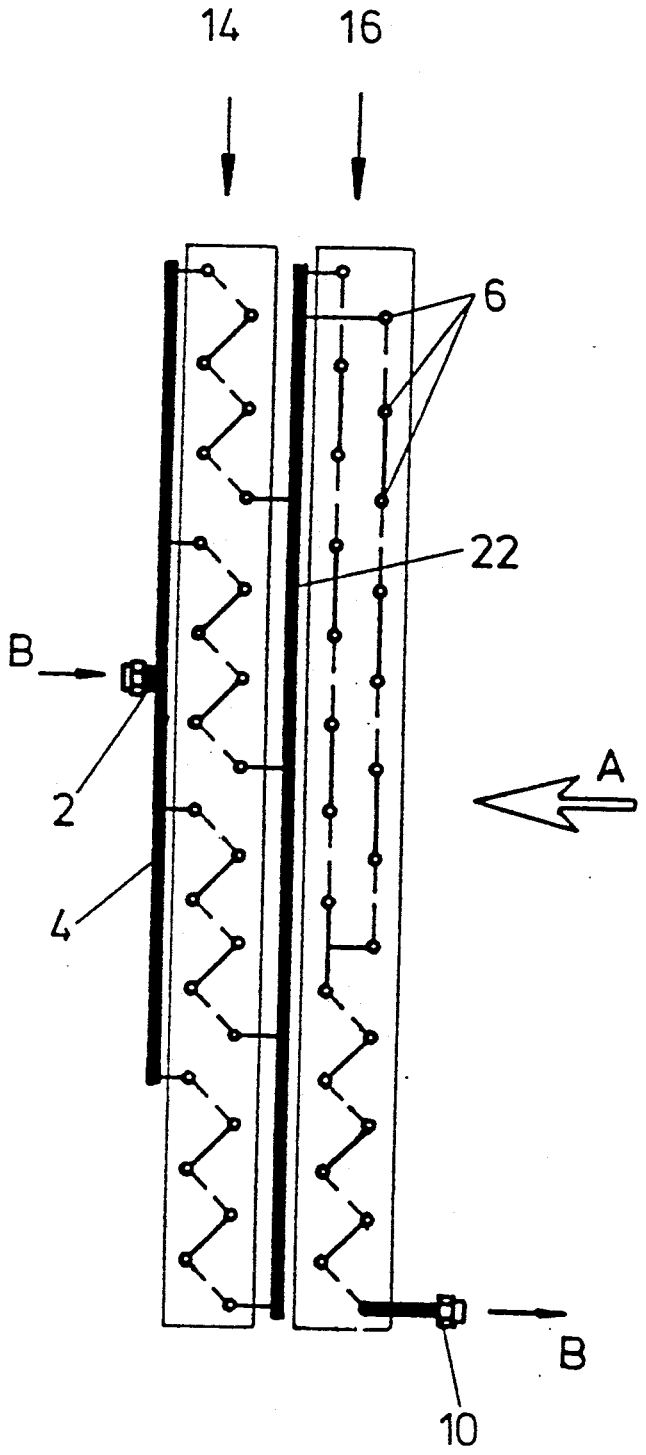
FIGS. 3 to 5 show different embodiments of a round tube liquefier showing the preferred interconnection of the heat exchange tubes carrying the coolant.
Figure 3A:
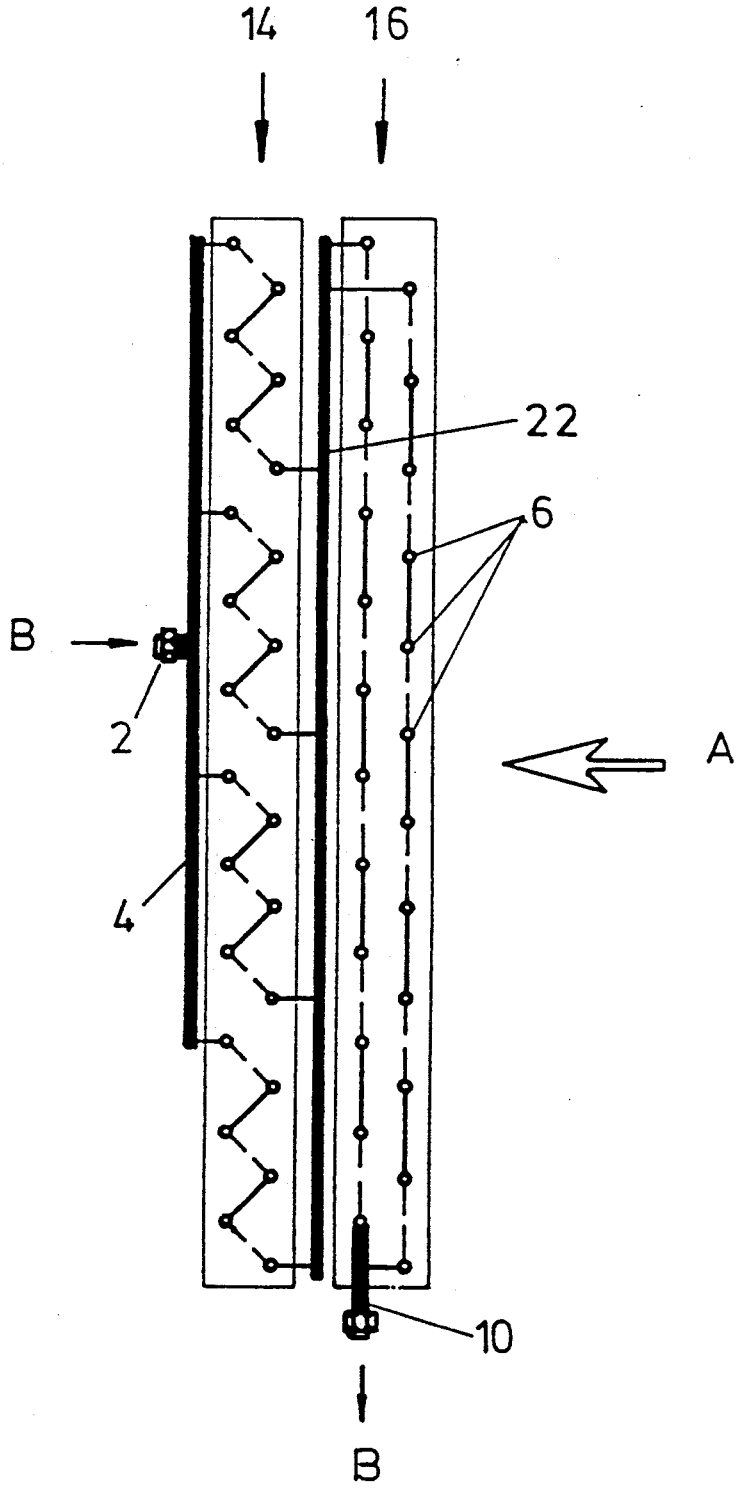
Figure 4A:
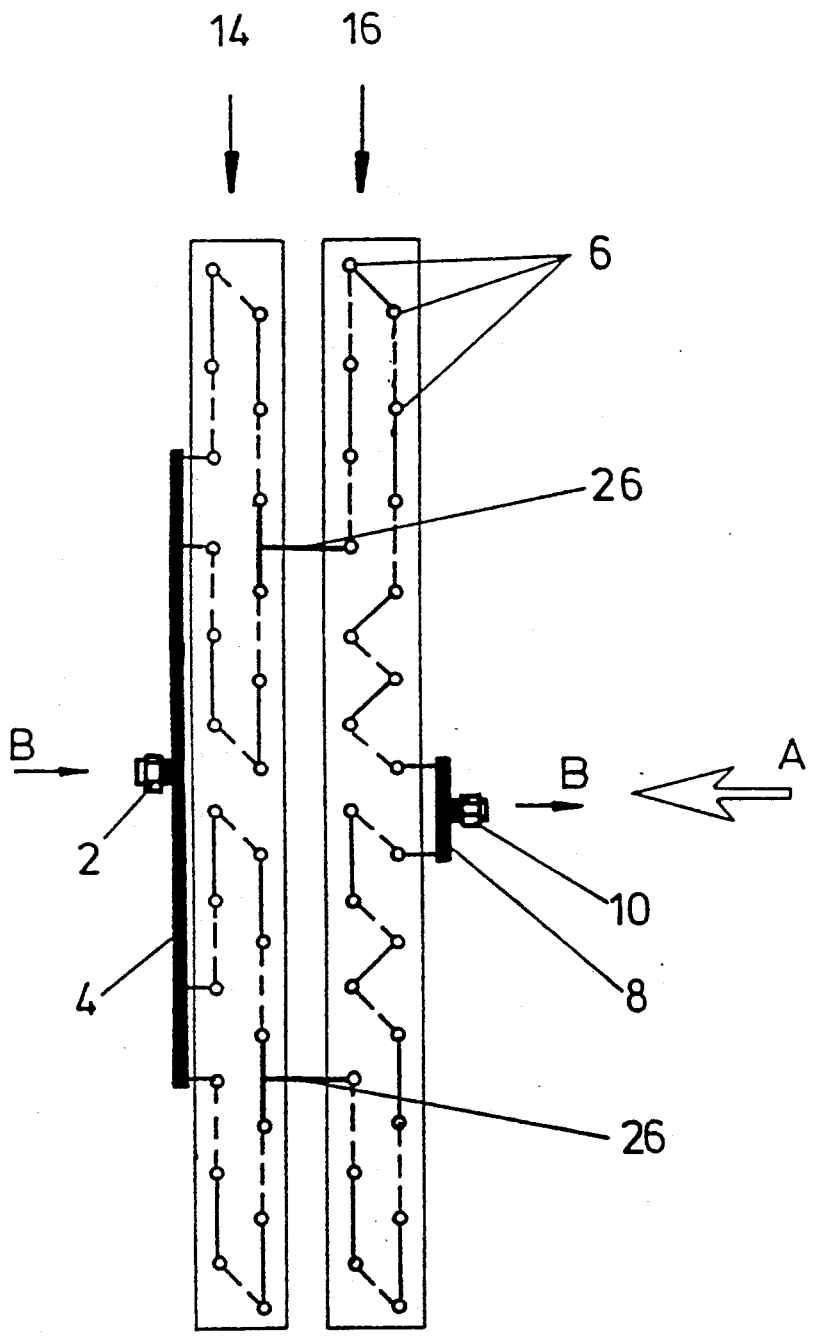
FIG. 4*b* is a schematic illustration of the interconnection of the heat exchange tubes of a four-row liquefier including four component groups. Insofar as the component groups are shown and described in FIGS. 1 to 5 as being physically separated, they should be considered as being supplemented by a joint fin arrangement and decoupling with respect to thermal conduction according to the invention.
Figure 4B:
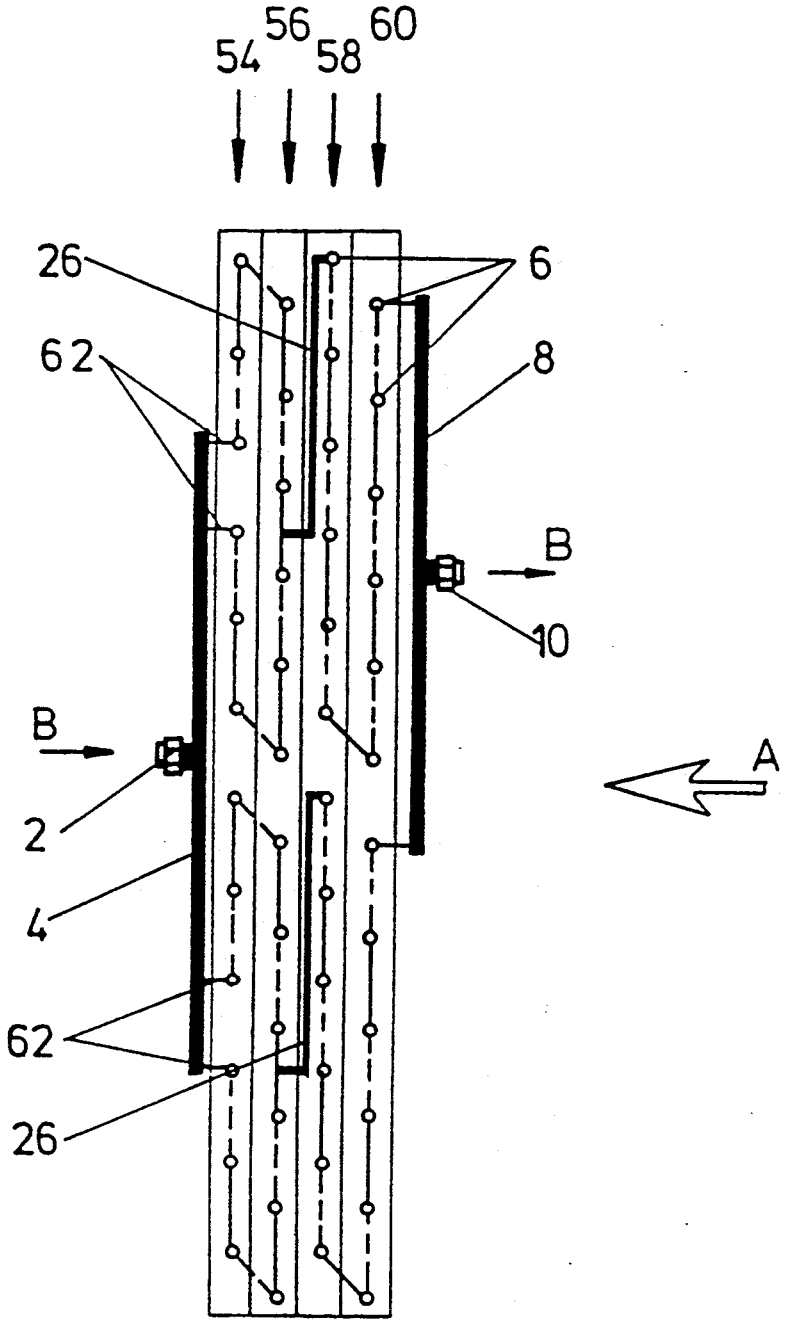
Figure 5:
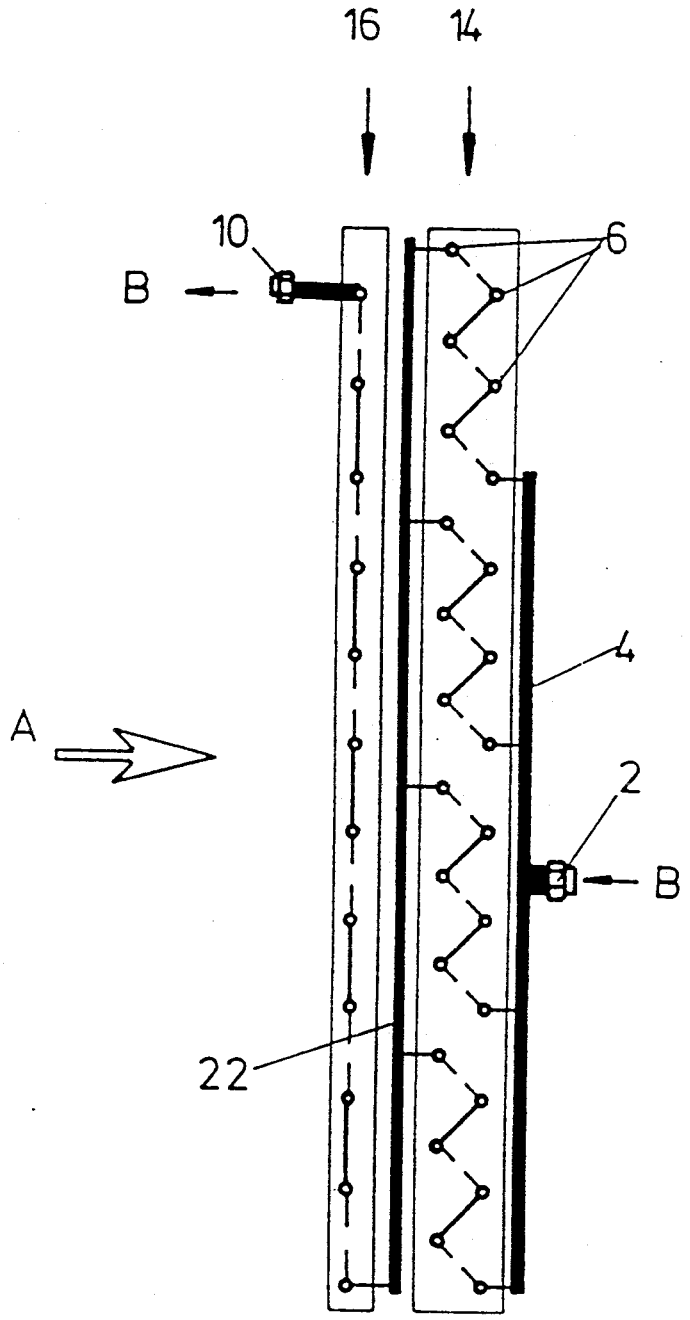

The special interconnections shown in FIGS. 3, 3*a*, 4 and 5 show preferred connections in the individual component groups; in the embodiments of FIGS. 3, 3*a* and 4 for a four-row liquefier and in the embodiment according to FIG. 5 for a three-row liquefier.

Figure 13:
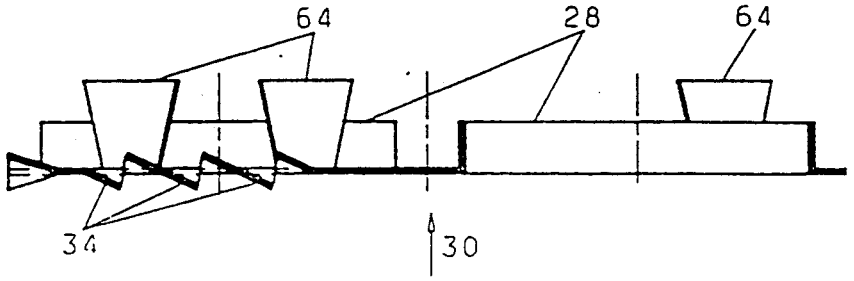
FIG. 13 is a sectional view along line B—B of FIG. 12, and FIGS. 14 and 15 show schematic interconnections of prior art coolant carrying tubes on which the invention is based; namely in cross-current in FIG. 14 and in cross-countercurrent in FIG. 15.

In the first embodiment of FIG. 3, coolant circuits are connected in parallel in the first component group 14 as this is shown in FIG. 13 for the prior art liquefier as a whole and not for only one component group as in FIG. 3.

The second component group in FIG. 3 is formed of only two parallel connected circuits so that, again with unchanging internal cross section of heat exchange tubes 6, the pressure loss in component group 16 is increased considerably relative to component group 14.

FIG. 3*a* varies this basic series connection of four circuits and two circuits in that an additional stage of again increased pressure loss is incorporated in component group 16 so that at the inlet, as in the case of FIG. 3, two flow circuits are connected in parallel which, however, at the outlet, are connected to a single flow circuit.

In a manner not shown, parallel connections of the type of component group 14 could also be continued in the inlet region of component group 16 or the interconnection measures of the type shown for component group 16 could begin already in component group 14.

In each one of the two embodiments shown in FIGS. 3 and 3*a*, an intermediate header 22 is connected between the two component groups 14 and 16.

FIG. 4*a* initially illustrates that the connection measure of FIG. 3 with four circuits in component group 14 and two circuits in component group 16 can also be obtained by a different manner of connecting the tubes. Moreover, the intermediate header has been omitted in that the individual circuits of component group 14 are converted in pairs, by means of so-called tripods 26, to flow into the two continuing circuits.

It is understood that the described connection measures can be analogously realized with other number of circuits in the individual component groups as well. However, the numbers and configurations illustrated here are preferred.

FIG. 4*b* shows the same liquefier as FIG. 4*a*, but with a consequent application of claims 1 and 3.

The illustrated four rows of tubes are all decoupled from one another with respect to thermal conduction by means of individual component groups 54, 56, 58 and 60.

In addition, the pressure loss on the coolant side from component groups 54, 56 to component groups 58, 60 is increased by the interconnection of respective parallel circuits 62 into one circuit by means of a tripod 26.

In a liquefier connected in this way, the short-circuit heat flow between heat exchange tubes in the fin is minimal.

This also applies for the particularly compact embodiment according to FIG. 5 which has only three rows.

Here, component group 14 is selected to be analogous to that of FIG. 3. However, the coolant flow is transferred from the four parallel circuits of component group 14 which is first in the flow of coolant to only a single circuit in component group 16.

In all embodiments of FIGS. 1 to 5, a common laminar fin arrangement which is substantially decoupled with respect to thermal conduction should be considered to be added; it will be described in greater detail below in connection with FIGS. 6, 7 or 12 and 13.

Figure 6:
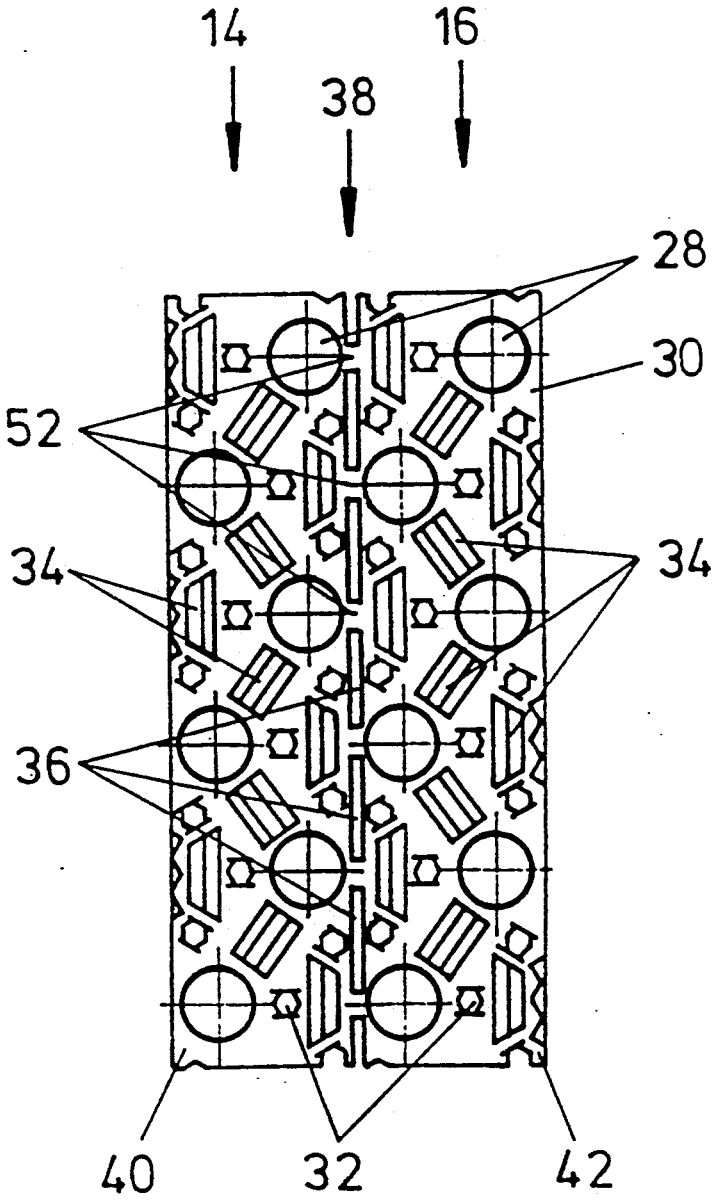
FIGS. 6 and 7 are plan views of a joint fin between two different arrangements of interruptions in the connection zone between adjacent component groups, incorporating known projection-like interruptions for increasing heat transfer.
Figure 7:
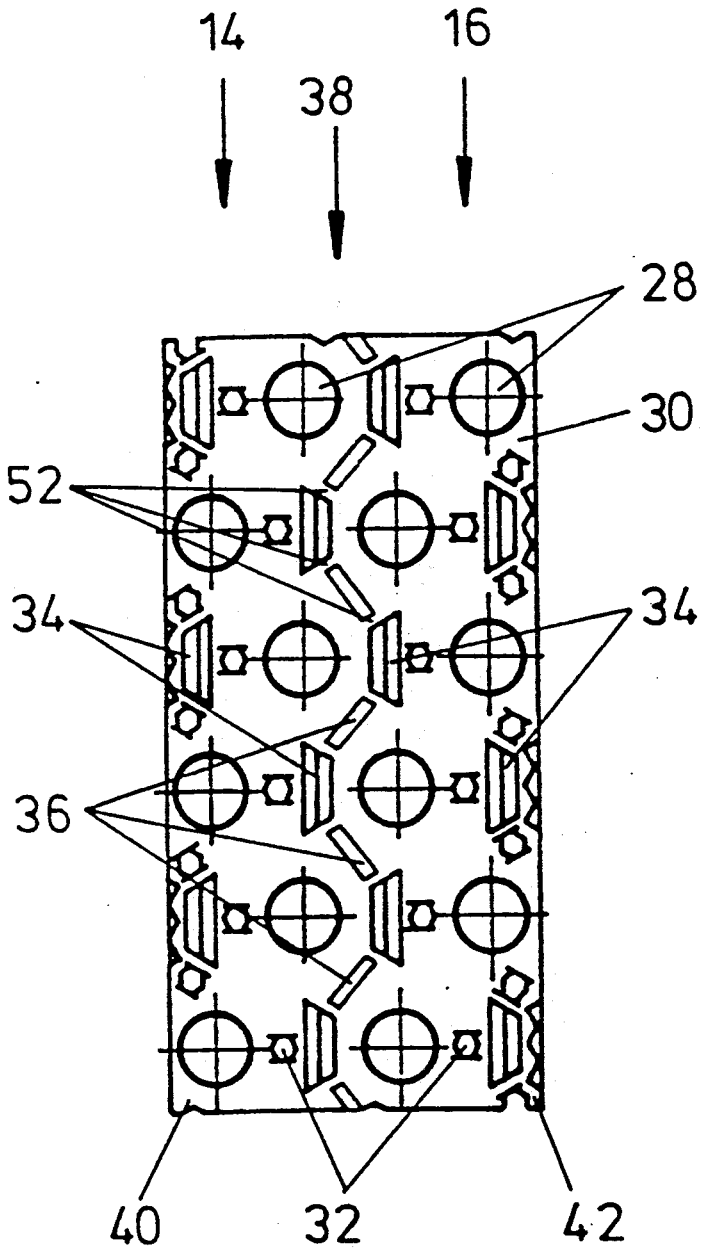

FIGS. 6 and 7 are top views of an individual heat exchange fin for a four-row arrangement of heat exchange tubes, not shown here. In the customary manner, one heat exchange tube in each tube bundle heat exchanger is arranged in a receiving opening 28 of fin 30 which is part of fin arrangement 12. The openings may here be configured in the customary manner, for example, to include connecting sleeves for connection to the respective heat exchange tube. The individual receiving openings 28 may here be considered to take the place of the arrangement of the header tubes.

The individual fins 30 are held at the proper mutual spacing in the customary manner by means of spacers 32 worked out of the fin, for example, as projecting flaps of fin material.

The arrangement of receiving openings 28 indicates initially their association with such liquefiers in which the heat exchange tubes 6 are offset to the middle between their gaps in the direction of flow of the ambient air.

Fin 38 initially includes the known projection-like perforations 34 provided to increase heat transfer which extend between adjacent receiving openings 28, each along a row of tubes and thus also transverse to those connection openings which are adjacent one another in the second next row of tubes. It can here be seen, in the embodiment of FIG. 6 as well as in that of FIG. 7, that such interruptions 34 are unable to decouple adjacent tubes of adjacent tube rows with respect to thermal conduction.

For the purpose of this decoupling with respect to thermal conduction, additional interruptions 36 are provided which, in the embodiment according to FIG. 6, extend parallel to interruptions 34 between the two interior rows of tubes. In the embodiment according to FIG. 7, however, they describe a polygon together with interruptions 34 and are arranged at an angle of 45° to the extent of the rows of receiving openings 28.

In the embodiment according to FIG. 6, the decoupling with respect to thermal conduction is additionally increased in that interruptions 34 and 36 are arranged so as to overlap one another. However, a good effect can also be realized without these overlaps, although the overlap is preferred because it increases the resistance to thermal conduction.

The succession of interruptions 34 and 36 here describes the direction in which a connection zone 38 extends between the two component groups 14 and 16 and between their associated regions 40 and 42 in fin 30.

Figure 8:
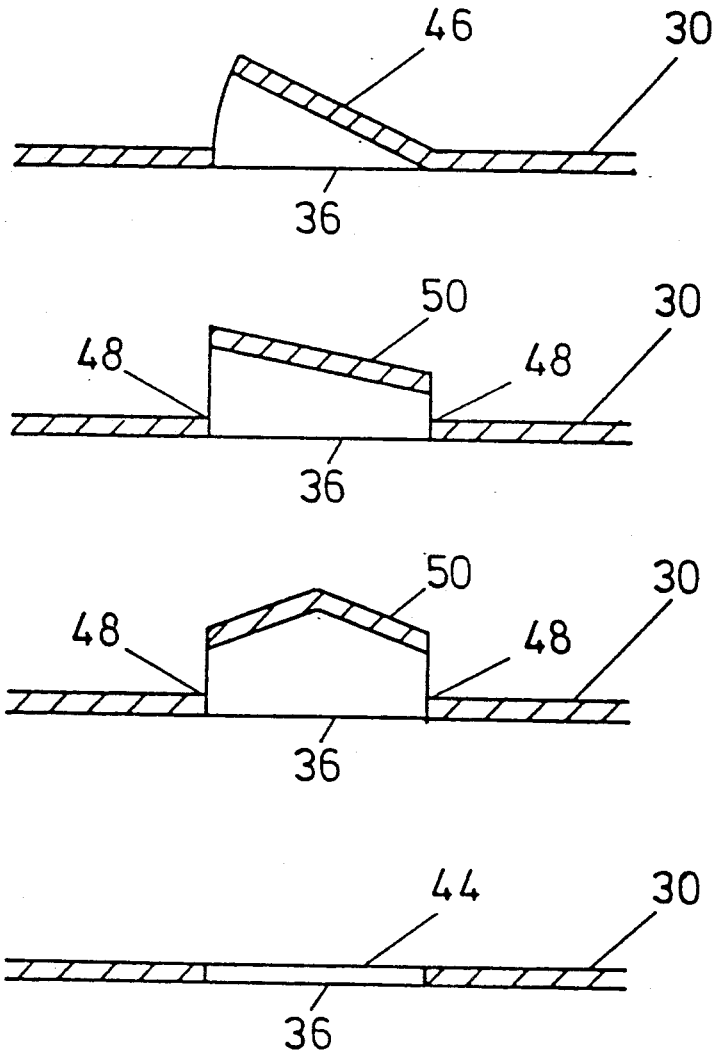
FIG. 8 illustrates possible structural shapes of such interruptions additionally provided within the scope of the invention for decoupling with respect to thermal conduction in three variations (a), (b) and (c) as projection-like interruptions as they are shown, in particular, in FIG. 7, or in variation (d) in the form of a simple slot as shown, in particular, in FIG. 6; however, embodiments provided with projection-like interruptions in an arrangement according to FIG. 6 or with slot-shaped interruptions as in the embodiment according to FIG. 7 are also possible.

Without limiting its general applicability, the interruptions 36 in the embodiment according to FIG. 6 are configured as simple slots 44 in the manner of variation (d) of FIG. 8.

Variations (a), (b) and (c) constitute preferred embodiments of the projection-like additional interruptions 36 shown in FIG. 7, which, moreover, are also known per se in connection with interruptions 34.

In variation (a), the projections of material are webs 46 bent on one side out of fin 30, preferably arranged in the manner of louvers.

In variations (b) and (c), however, the projections of material are cut out of the fins on both sides by way of cut locations 48 so that roof-like raised portions 50 are created which are each connected in on piece with fin 30 only at their end faces. Variation (b) here describes a flat roof and variation (c) a gable roof, with various shapes being possible and also customary in connection with interruptions 34. Correspondingly, interruptions 34 may have all the shapes selected in FIG. 8, variations (a) through (c). In the extreme case, simple slots according to variation (d) could also be provided here in deviation from custom so that then interruptions 34 as well as interruptions 36 serve only for decoupling with respect to thermal conduction.

The same applies similarly for the embodiment of FIG. 6 as well as to the embodiment according to FIG. 7. Analogously, the arrangement can also be transferred to three-row fin arrangements or those having other numbers of rows.

Interruptions 36 and, if the known interruptions 34 are incorporated, these as well are each separated from one another along connection zone 38 by relatively narrow connecting webs 52 so that the flow of heat takes place solely through these narrow connecting webs and thus the average thermal conductivity along connection zone 38 is reduced corresponding to the ratio of interruption to connecting web.

Figure 9:
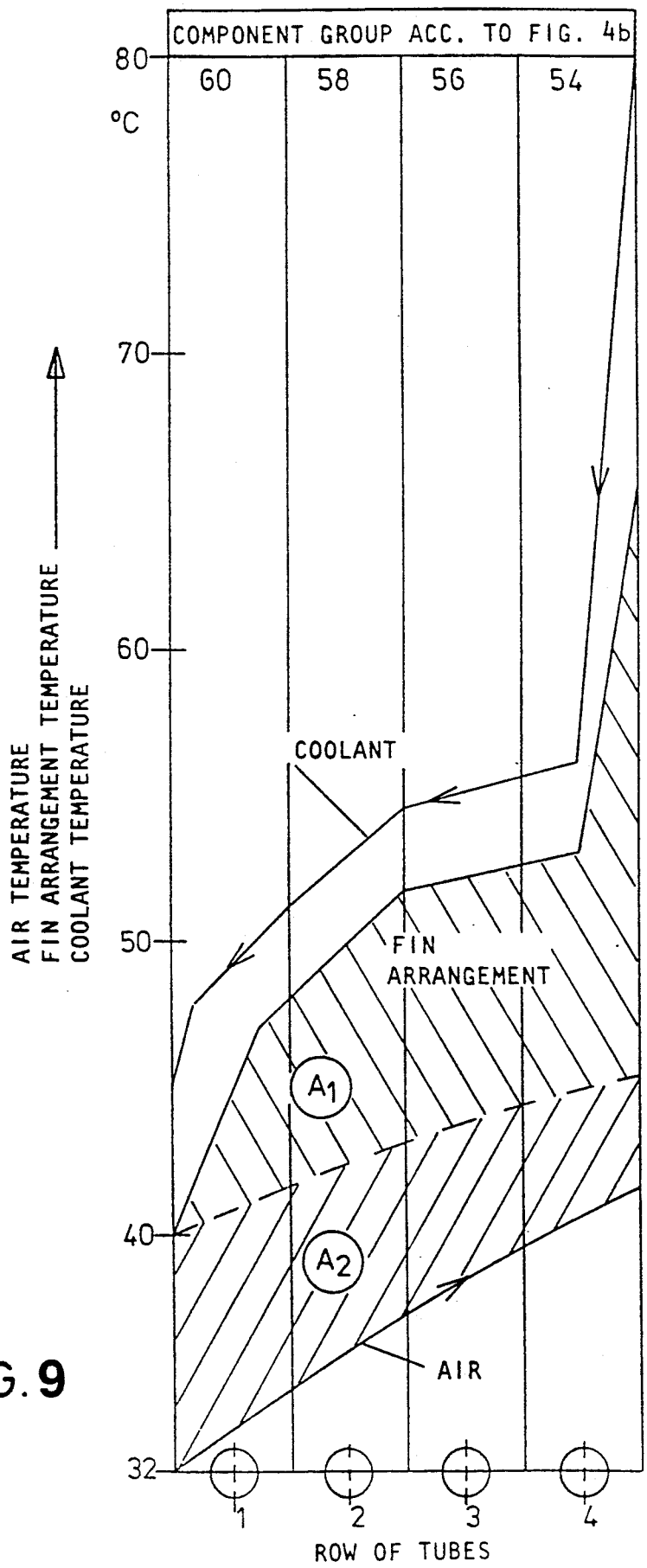

FIG. 9 shows the temperature curve of the ambient air flowing through the liquefier and of the coolant flowing in cross-countercurrent to the ambient air through three direction reversing turns. The coolant is here conducted in cross-current to the air in the tubes of one component group and in direction reversing turns from component group to component group, that is, in countercurrent to the air. Within a component group, the coolant may also be conducted in cross-countercurrent with one or two direction reversing turns if the component group is composed of more than one row of tubes. However, due to the small distance between adjacent tubes of different rows of tubes, the different temperatures are averaged by the fin so that the greater temperature difference does not become effective in cross-countercurrent in contrast to tubes arranged in pure cross-current flow.

FIG. 9 therefore shows a solution that has been optimized for the effective temperature difference in which each row of tubes one to four according to FIG. **4*b* is associated with one of component groups 54, 56, 58, 60**, respectively.

With such a division of a, for example, four-row, liquefier in likewise four component groups 54, 56, 58 and 60, the coolant temperature which decreases in the direction of coolant flow as shown in FIG. 9 cannot be compensated by short-circuit heat flow in the fins, rather the curve shown in solid lines in FIG. 9 results as the fin arrangement temperature which lies below the likewise shown coolant temperature curve.

In a prior art liquefier connected in cross-countercurrent flow as shown in FIG. 13, under the condition that the same exit temperature is to be realized, the fin arrangement temperature is considerably lower on the average since the heat in the fin flows from the heat exchange tubes having the higher temperature at the liquefier inlet to the heat exchange tubes having the lower temperature at the liquefier outlet.

The effective temperature difference can be illustrated graphically by the area between the fin arrangement curve and the air temperature curve.

FIG. 9 shows the increase in effective temperature difference of a liquefier connected according to claims 1 and 3 compared to a prior art liquefier likewise connected in cross-countercurrent as the hatched area (A1).

In contrast to the effective temperature difference of a liquefier connected according to the prior art as illustrated by the hatched area (A2), the liquefier according to the invention more than doubles the effective temperature difference. Since the illustrated temperature curve corresponds to the average operating state of a vehicle air-conditioning system, smaller air velocities, i.e. greater heating of the air, makes possible an even greater increase in effective temperature difference by the liquefier according to the invention.

Figure 10:
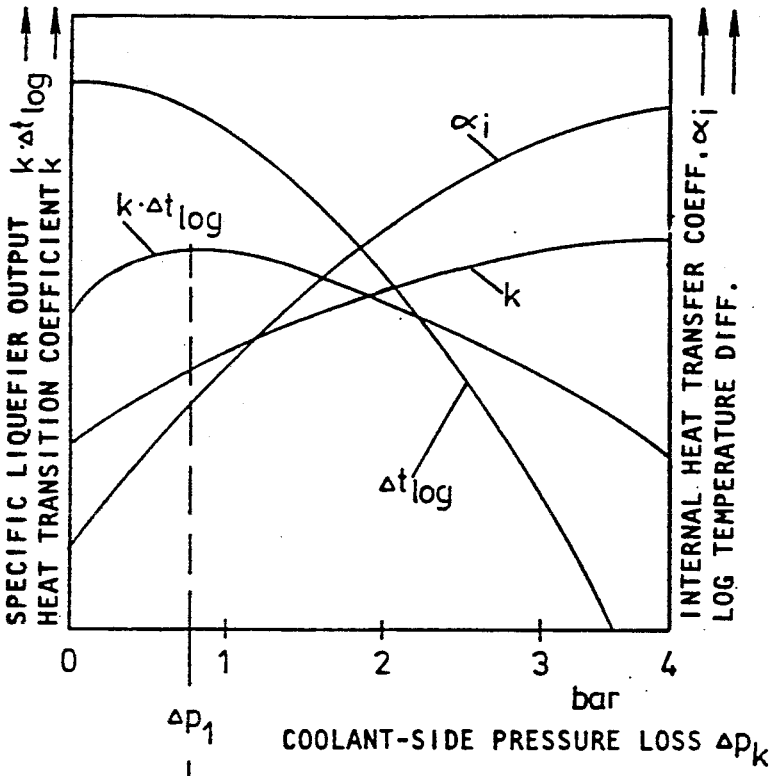

FIGS. 10 and 11 show optimization criteria for the pressure loss on the coolant side. The temperature curve developing in the coolant circuit with different pressure losses on the coolant side is shown in the coolant state diagram of FIG. **11*b***.

The coolant side pressure loss in each individual component group must be selected in such a manner that the exit temperature of the liquefied coolant $t_{KA}$ lies in a range between its minimum $t_{KA1}$ and the minimum of the saturation temperature $t_{KE1}$ of the coolant entering into the liquefier.

Figure 11A:
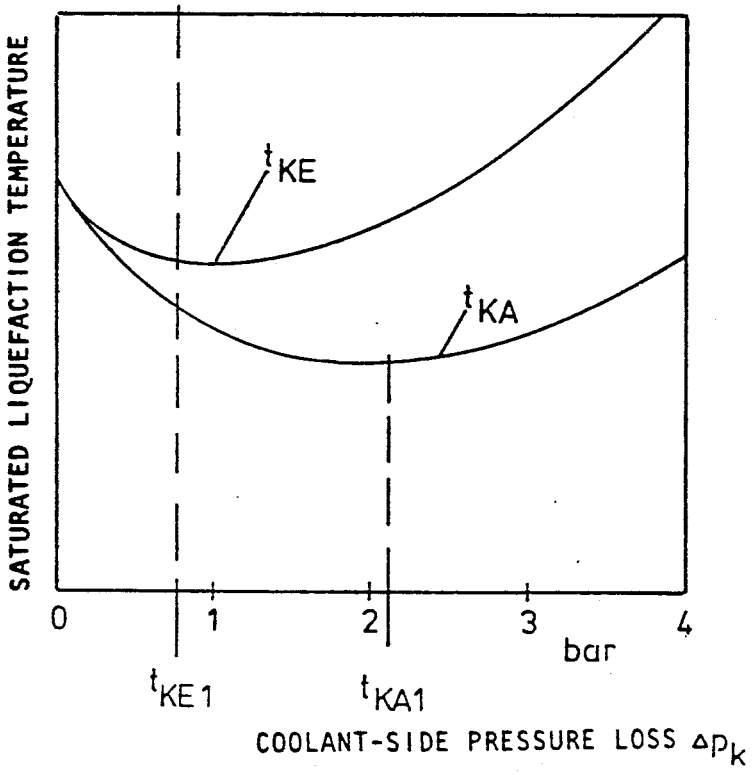
Figure 11B:
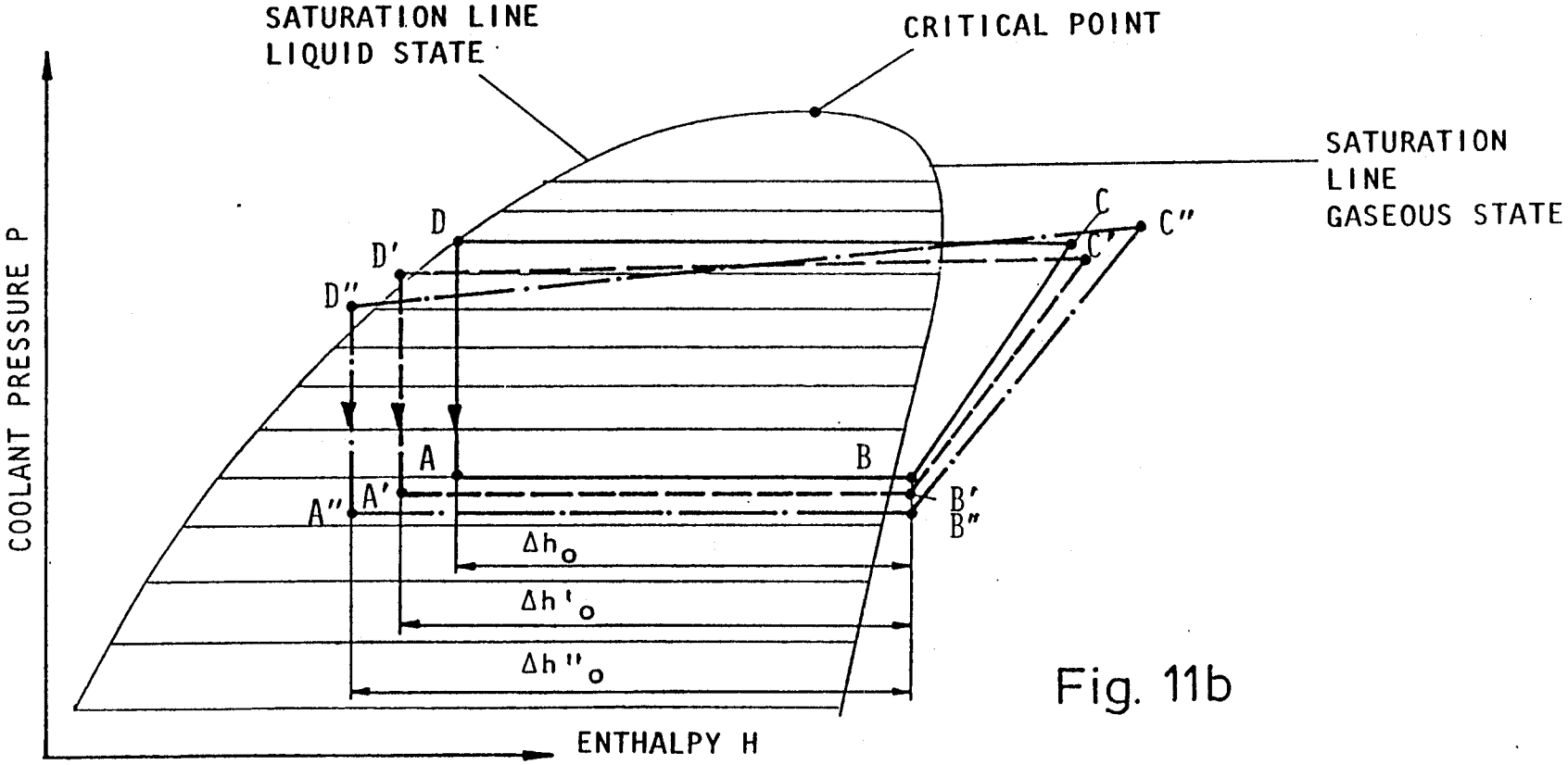
FIG. 11*b* is a coolant state diagram in which coolant circuits are plotted which correspond to the different liquefier configurations discussed in connection with FIGS. 10 and 11 with respect to their pressure loss on the coolant side, FIG. 12, similar to FIG. 7 is a plan view of a liquefier fin according to the invention.

FIGS. 10, 11*a* and 11*b* will now be described with reference to examples.

If one selects a configuration involving a very low pressure loss on the coolant side, e.g. 0.05 bar, the internal heat transfer coefficient $\alpha$, plotted qualitatively in FIG. 10 over the pressure loss on the coolant side, is minimal.

From the minimal pressure loss $\Delta p_K$ on the coolant side results a maximum effective temperature difference, marked $\Delta t_{log}$ in FIG. 10, between the coolant, on the one hand, and the ambient air, on the other hand, since the saturation temperature does not decrease in the course of the coolant flow path. On the other hand, the heat transition coefficient (marked K in FIG. 10) is small due to the minimal internal heat transfer coefficient.

The product of heat transition coefficient and effective temperature difference (marked $K \cdot \Delta t_{log}$ in FIG. 10) therefore does not reach its maximum value at 0.05 bar pressure loss on the coolant side.

For this reason, the minimum liquefaction temperature (marked $t_{KE}$ in FIG. 11*a*) is also not reached under constant operating conditions at the inlet of a given coolant circuit in a vehicle air-conditioning system since, due to the lower heat transition coefficient K, under otherwise constant conditions (such as external surface area, ambient temperature, etc.) the saturation temperature of the coolant $t_{KE}$ and the saturation pressure $p_{KE}$ must be higher than in a design involving a higher heat transition coefficient. Due to the low pressure loss on the coolant side, a reduction of the coolant exit temperature (marked $t_{KA}$ in FIG. 11*a*), as it is desired for cooling the interior of the motor vehicle, is additionally prevented.

The coolant circulation process developing in a liquefier having low pressure losses on the coolant side, e.g. 0.05 bar, is shown in the coolant state diagram of FIG. 11*b*.

FIG. 11*b* shows the binodal curve for the liquid state and the binodal curve for the gaseous state which intersect at the critical point and could also be called "saturation lines."

The state of the coolant is described primarily by the coolant pressure P and the enthalpy h which are plotted as ordinate and abscissa, respectively, in FIG. 11*b*. The following is shown:

Point A: entrance into the evaporator;

Point B: exit from the evaporator and entrance into the condenser;

Point C: exit from the condenser and entrance into the liquefier;

Point D: exit from the liquefier and entrance into the throttle member of the coolant circuit.

The circulation process developing in liquefiers having a pressure loss of 0.05 bar on the coolant side is shown at A, B, C and D in FIG. 11*b*, with the direction of the coolant circulation being indicated by an arrow. The three illustrated coolant circuits realize an average entrance pressure $p_{KE}$ at point C, while the exit pressure $p_{KA}$ and thus also the saturation temperature associated with the vapor pressure curve is by far the highest at point D. Since the undercooling of the liquid coolant to values below the saturation temperature corresponding to the pressure takes on comparable values in all liquefier structures whose liquid coolant is able to flow off unimpededly from the liquefier, the coolant exit temperature measured by a thermometer at the outlet of the liquefier is also comparatively high. Since the enthalpy h rises with the temperature of the liquid coolant, the entrance enthalpy of the coolant into the evaporator is also highest at Point A.

For this reason, a comparatively low enthalpy difference $\Delta h_o$ is available in the evaporator for heat absorption, if the coolant coming from the evaporator is constantly superheated, so that each kilogram of coolant circulated by the condense is able to absorb less heat than in the other two coolant circulation processes marked ′ and ″, respectively. This again, with otherwise constant conditions, leads to a comparatively high evaporation pressure (Points A and B) and the resulting higher air exit temperature from the evaporator and finally a comparatively high temperature in the interior.

If one increases the pressure loss on the coolant side to a value of about 0.7 bar which is optimum for the liquefier and is marked $t_{KE1}$ in FIGS. 10 and 11*a*, the effective temperature difference in FIG. 10 drops but, on the other hand, the internal heat transfer coefficient $\alpha_1$ and thus also the heat transition coefficient K increase. Since, according to FIG. 10, for a pressure loss at the coolant side between 0.05 bar and 0.7 bar, the increase of the heat transition coefficient is greater than the decrease in effective temperature difference, the product of the effective temperature difference and the heat transition coefficient, $K \cdot \Delta t_{log}$, which is decisive for liquefier performance, reaches its maximum at the coolant-side pressure loss $t_{KE1}$ of FIG. 10 which, as already explained, is equivalent to the minimum of the saturation temperature $t_{KE}$ at the inlet of the liquefier as shown in FIG. 11*a*. Due to the pressure loss on the coolant side which is higher about 0.65 bar at $t_{KE1}$, the saturation temperature at the liquefier outlet $t_{KA}$ is reduced further.

If one considers the last described coolant liquefier in the entire coolant circuit according to FIG. 11*b*, the minimum coolant entrance pressure $p_{KE}$ can be seen, which is equivalent to the minimum saturated coolant entrance temperature $t_{KE1}$ at point C′, and the pressure loss $\Delta p_K$ of the liquefier represented by the drop toward the left, with the consequence that the exit pressure $p_{KA}$ and the coolant exit temperature are lower and therefore the enthalpy difference $h_o'$ available to the evaporator is greater than in a liquefier operating with a pressure loss of 0.05 bar on the coolant side.

As already mentioned, this results in a comparatively lower evaporation, air exit and vehicle interior temperature.

A further reduction of the liquefier exit temperature $t_{KA}$ beyond this value can be realized by a further increase in the pressure loss at the coolant side from $t_{KE1}$ to $t_{KE2}$.

With these dimensions, however, the liquefier performance defined by $K \cdot \Delta t_{log}$ is no longer at a maximum since the effective temperature difference decreases more strongly than the heat transition coefficient increases s that the saturation temperature at the liquefier inlet also increases (see Point C″ in FIG. 11*b*).

If, however, liquefiers are employed which have a "steep characteristic", i.e. a volume conveyed almost independently of the conveying pressure, the coolant entrance pressure $p_{KE}$, which according to the vapor pressure curve rises together with the saturation temperature $t_{KE}$, does not reduce the coolant mass flow so that the maximum enthalpy difference $\Delta h_o''$ of the coolant in the evaporator resulting from the coolant exit temperature at the outlet of the liquefier (Point D'' in FIG. 15) leads to a further reduction of the evaporation pressure at Points A'' and B'' and thus to the minimum possible air exit temperature from the evaporator and the maximum possible cooling of the interior.

In the liquefier referred to in FIGS. 1 2 and 13, three component groups 14, 15 and 16 are provided, without limiting its general applicability, which are each associated with a single row of tubes. Shown is only one fin of the fin packet constituting the fin arrangement of the corresponding heat exchange tubes. Each fin 30 is here provided with receiving openings 28 into which a heat exchange tube is pressed in a mechanically firm seat and so as to be thermally conductive. It can be seen in FIG. 13 that the corresponding receiving openings 28 project like sleeves from the plane of the fin.

The distribution of receiving openings 28 also indicates that the heat exchange tubes are arranged, when seen in the direction of flow A of the ambient air, in a mutually uniformly offset arrangement, with the tubes of one row being placed in the gaps between the tubes of the other row.

The succession of interruptions 36 provided between the individual component groups includes the known interruptions 34 which are each disposed transversely between pairs of heat exchange tubes (and receiving openings 28) belonging to different rows of tubes of mutually separated component groups 14, 15 and 16.

Thus interruptions 34 and 36 form succession of interruptions in rib 30, along the respective connection zone 38 between component groups 14 and 15 and between groups 15 and 16, respectively, between which connecting webs 52 remain and which are each disposed between pairs of heat exchange tubes and receiving openings 28 which belong to immediately adjacent rows of tubes of the respectively adjacent component groups, here rows of tubes.

Interruptions 36 are here configured specifically according to the uppermost variation of FIG. 8 as elongate slots having a projection on one side. The known interruptions 34, however, are configured as louvers whose specific shape becomes clear from FIG. 13. There are two central full webs and two outer half webs which are set outward parallel to one another and form an angle of incidence of preferably 15° to 30° relative to the air.

In the offset tube arrangement, interruptions 34 in the form of louvers extend longitudinally in the same tube row between adjacent tubes of the same tube row or, in other words, they extend transversely, that is separatingly, between adjacent tubes of tube pairs arranged behind one another in influx direction A and are each separated from the other by a row of offset tubes disposed therebetween.

Figure 12:
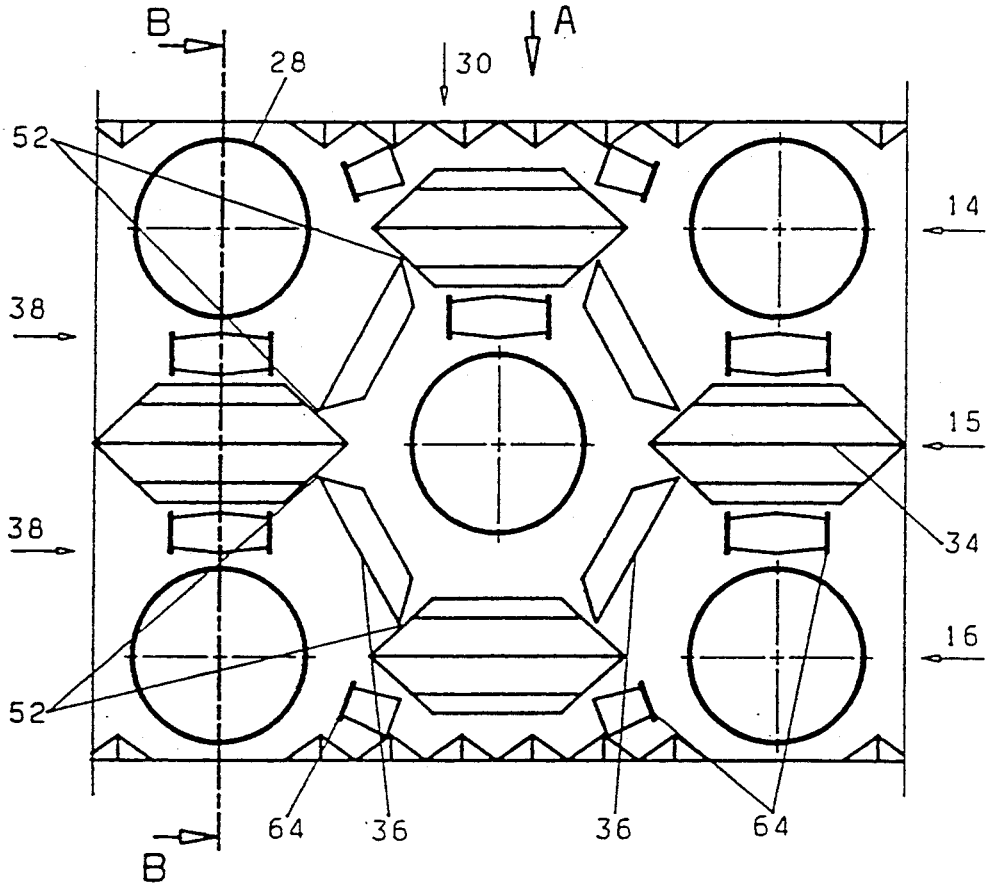

Also visible are spacers 64 which project at a greater height from the fin plane on the same side as the sleeves of receiving openings 28 so as to space the individual fins in the compressed fin packet. Possible configurations and dimensions of such projections are known per se. FIGS. 12 and 13 show two different, preferred possible configurations which differ by the webs projecting on one or both sides. Advisably, the projecting webs according to FIG. 13 are conical so as to not intrude into the oppositely disposed projection opening of the next spacer of the adjacent fin.

Fins 30 are also advisably made of foils of aluminum, copper or alloys of these materials less than 0.15 mm thick.

Preferred in the configuration in the sense of FIG. 12 or 13 are liquefiers having three or four rows of tubes, with, however, in the sense of the preceding description, liquefiers having only two rows of tubes also being possible.

The individual rows of tubes each have a fin 30 in common; they are held together by means of connecting webs 52 which remain between the interruptions.

I claim:

1. A liquefier for the coolant in a vehicle air-conditioning system, said liquefier comprising:

a plurality of finned heat exchange tubes through which the coolant is conducted in a cross-current to the inflowing ambient air, with the heat exchange tubes being arranged in a plurality of rows of tubes disposed behind one another in the direction of flow of the incoming ambient air so that the respective heat exchange tubes are interconnected in a cross-countercurrent arrangement, and with the tubes of adjacent rows of tubes being offset relative to each other in the direction of flow of the ambient air;

the rows of tubes being subdivided into a plurality of component groups which are arranged behind one another in the direction of flow of the incoming ambient air; and the component groups being connected in series with respect to the direction of flow of the coolant and in countercurrent to the direction of flow of the incoming ambient air, with adjacent component groups being mechanically connected by way of said fin arrangements;

a respective connection zone, disposed between each two adjacent of said component groups, in which the average thermal conductivity $\lambda_m$ lies below 20% of the thermal conductivity $\lambda$ of the material of the fin arrangement of the two adjacent said component groups, each said connection zone including means for defining a plurality of first interruptions between which first connecting webs remain in said material of said fin arrangement, with one of said first interruptions extending transversely between each respective pair of offset tubes which belong to directly adjacent rows of tubes of directly adjacent component groups; and means for defining a plurality of second interruptions between which second connecting webs remain in said material of said fin arrangement, with one of said second interruptions being disposed between each respective adjacent pair of tubes in at least a row of tubes of a component group adjacent said connecting zone; and said plurality of interruptions and said second plurality of interruptions of respective adjacent rows of adjacent component groups collectively define a polygonal curve.

2. A liquefier according to claim 1, wherein in the connection zone, the average thermal conductivity $\lambda_m$ lies below 10% of the thermal conductivity $\lambda$ of the material of the fin arrangement of the two adjacent component groups.

3. A liquefier according to claim 1, wherein each row of heat exchange tubes forms a component group.

4. A liquefier according to claim 1, wherein said first interruptions are configured as gaps in the material of the fin arrangement.

5. A liquefier according to claim 4, wherein the gaps in the material are slots which extend along the connection zone.

6. A liquefier according to claim 1, wherein at least some of said interruptions are configured as projections of material.

7. A liquefier according to claim 6, wherein the projections of material are webs which are bent out of one side of the fin arrangement so as to form louvers.

8. A liquefier according to claim 6, wherein said projections of material are cut out on both sides of the fin arrangement.

9. A liquefier according to claim 1, wherein said second interruptions are configured as louvers.

10. A liquefier according to claim 1, wherein the connection zone extends along a polygonal or wavy curve between adjacent two component groups.

11. A liquefier according to claim 1, wherein all interruptions of the sequence are parallel to one another.

12. A liquefier according to claim 11, wherein adjacent interruptions of the sequence overlap one another.

13. A liquefier according to claim 1, wherein only two component groups are provided.

14. A liquefier according to claim 1, wherein a first component group through which the coolant flows first is configured to have a relatively low pressure loss on the coolant side and a second component group through which the coolant flows subsequently is configured to have a relatively high pressure loss on the coolant side.

15. A liquefier according to claim 14, wherein the pressure loss of the first component group is dimensioned in such a way that the product of the effective temperature difference ($\Delta t_{log}$) between the ambient air and the coolant, and the thermal transition coefficient k is a maximum value.

16. A liquefier according to claim 14, wherein the pressure loss of the second component group is dimensioned so large that the exit temperature ($t_{KA}$) of the liquefied coolant lies in the range between its minimum and the minimum of the saturation temperature ($t_{KE}$) of the coolant entering into the liquefier.

17. A liquefier according to claim 1, wherein the fin arrangement comprises foils made of aluminum, copper, or alloys of these materials having a thickness of less than 0.15 mm.

18. A liquefier according to claim 1, wherein, as measured in the direction in which the connection zone extends, the average length of said first connecting webs is less than 50% of the average length of said first interruptions.

19. A liquefier according to claim 18, wherein the average length of said first connecting webs is less than 20% of the average length of said first interruptions.

20. A liquefier according to claim 19, wherein the average length of said first connecting webs is less than 10% of the average length of said first interruptions.

* * * * *